United States Patent [19]

Lembke

[11] Patent Number: 4,682,063

[45] Date of Patent: Jul. 21, 1987

[54] CONTROL MOTOR FOR A SERVO VALVE

[75] Inventor: Herbert Lembke, Lohr, Fed. Rep. of Germany

[73] Assignee: Mannesmann Rexroth GmbH, Lohr, Fed. Rep. of Germany

[21] Appl. No.: 820,730

[22] Filed: Jan. 21, 1986

[30] Foreign Application Priority Data

Jan. 21, 1985 [DE] Fed. Rep. of Germany ..... 3501836

[51] Int. Cl.[4] ..... F15B 13/043; H01F 7/14

[52] U.S. Cl. ..... 310/29; 137/625.62; 310/154

[58] Field of Search ..... 137/625.62, 625.64; 251/139; 310/29, 154, 191; 335/229, 230

[56] References Cited

U.S. PATENT DOCUMENTS 4,456,031 6/1984 Taplin ..... 137/625.62
4,514,710 4/1985 Conrad ..... 335/230
4,518,937 5/1985 Parker ..... 335/230
4,624,284 11/1986 Lembke ..... 137/625.64

OTHER PUBLICATIONS

Rexroth, "The Hydraulic Trainer: Servo Valves", RE 00301 Mannesmann—Rexroth Brochure (undated).

*Primary Examiner*—Patrick R. Salce
*Assistant Examiner*—D. L. Rebsch
*Attorney, Agent, or Firm*—Cushman, Darby & Cushman

[57] ABSTRACT

A control motor for a servo valve which includes pole screws defining an armature space, first and second spools or coils supported by the pole screws, respectively, a soft metal armature which is resiliently mounted to a thin walled tube and a samarium cobalt permanent magnet. The permanent magnet polarizes the armature so that when the spools or coils are energized, the armature will move toward one of the coils and away from the other coil.

7 Claims, 3 Drawing Figures

CONTROL MOTOR FOR A SERVO VALVE

The invention relates to a control motor, and refers more particularily to a control motor for a servo valve. Servo valves are known for a long time and are disclosed for instance in the prospectus RD-29633 of Rexroth GmbH in Lohr/Main, West Germany.

The control motor of the servo valve shown in said prospectus comprises an armature having wings extending radially outwardly, coils between which said wings are arranged, and a resilient tube at which said armature is mounted. Such an armature has a relatively large mass, with the consequence that only a low frequency response will be obtained. It is also not considered to be advantageous that the known motor requires relatively greater space because of the radial extending wings.

German published application No. 24 19 311 relates to a control motor using for energization purposes a permanent magnet which is "double polarized", i. e. uses two poles of the same polarity. Such a magnet has the disatvantage that its magnetization may be not uniform, with the result that the armature may be subjected to non-uniform effects. Because of this non-uniformity a calibration operation is required. This means additional work. Another disadvantage of the known design is the possibility that during operation the magnet will be de-magnetized. Common magnets, as for instance AlNiCo magnets, are weakened by external fields. Also, when taking apart the control motor and even at a time when the magnet is removed from the magnetizing apparatus, an undesired change and weakening of the magnetic field may be caused.

It is an object of the invention to provide a compact control motor. According to another object of the invention the control motor of the invention should be adapted for small power ratings.

Another object of the invention is to provide a control motor having a permanent magnet which does not cause a non-uniform energization. According to another object of the invention no undesirable problems should occur when assembling and disassembling the control motor.

In accordance with the present invention a control motor is provided, a control motor which is particularily useful together with a servo valve. The control motor of the invention comprises pole means, control spools supported by said pole means, an armature consisting of a magnetically soft material, a thin walled tube on which said armature is resiliently mounted, an armature space defined by said pole means and adapted to receive said armature, permanent magnet means comprising a permanent magnet located adjacent to said armature, said permanent magnet being of the single polarized type and consisting of samarium cobalt material.

Preferred embodiments of the invention are disclosed in the subclaims.

With the above and other objects in view which will appear as the description proceeds, this invention results in the novel construction, combination and arrangement of parts substantially as hereinafter described and more particularily defined by the appended claims, it being understood that such changes in the precise embodiment of the herein disclosed invention may be made as comes within the scope of the claims.

The accompanying drawings illustrate one complete example of the physical embodiment of the invention constructed according to the best mode so far devised for the practical application of the principles thereof, and in which.

Figure 1:
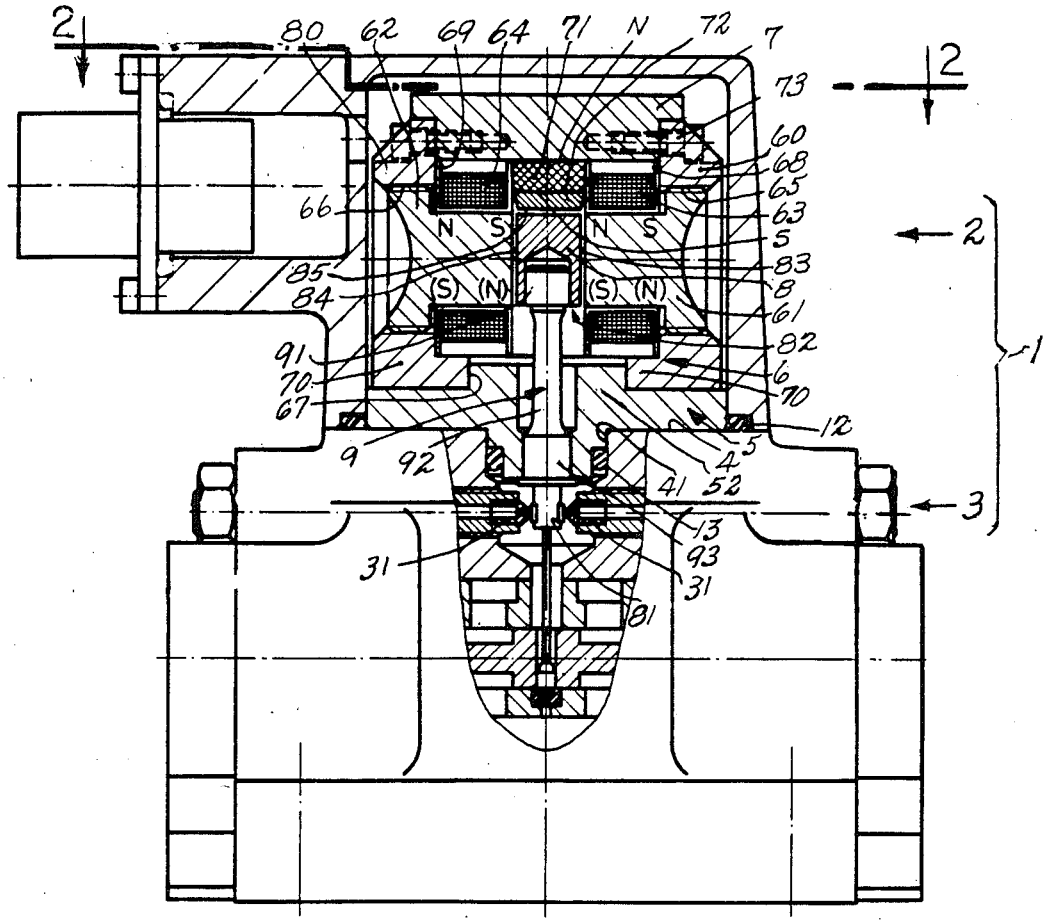
FIG. 1 is a sectional view through FIG. 2 on the plane of the line A—A of a servo valve.
Figure 2:
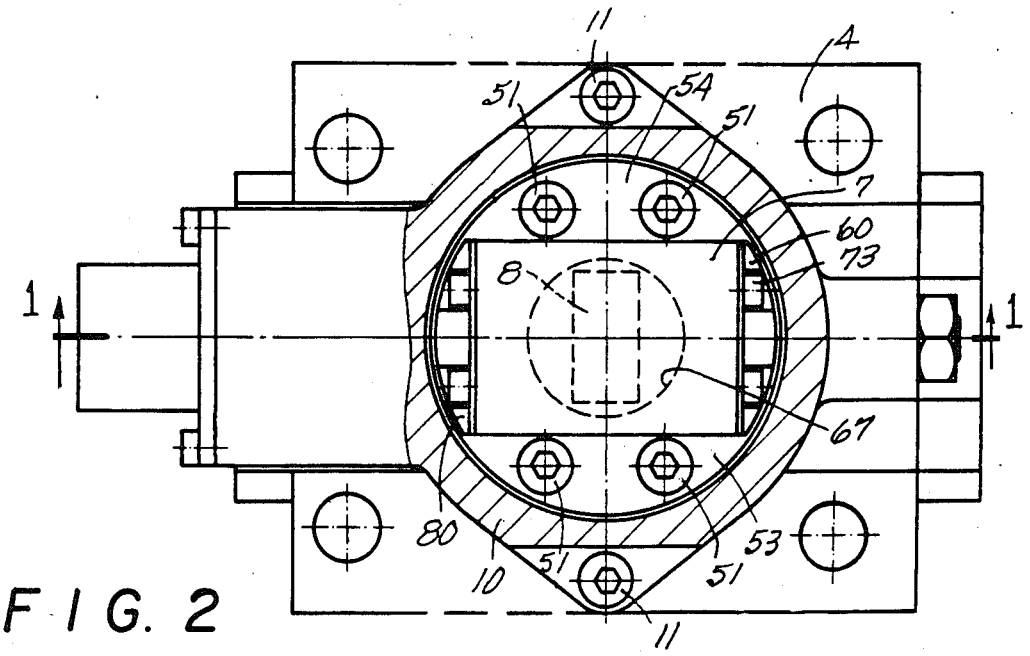
FIG. 2 is a plan view of the servo valve in FIG. 1 seen from the sectional line B—B in FIG. 1
Figure 3:
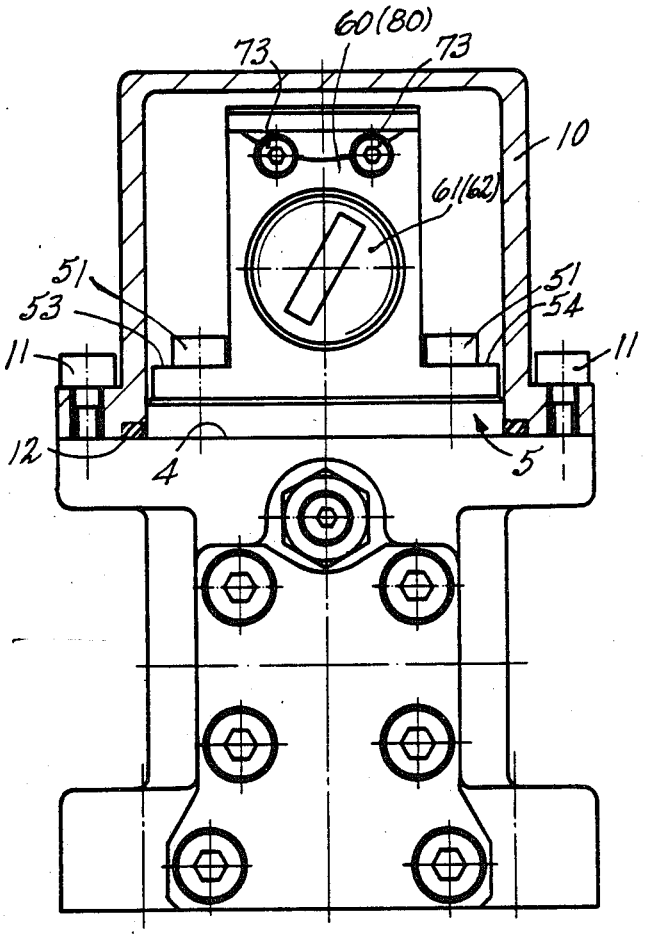
FIG. 3 is an elevational view of the servo valve as seen from the right hand side in FIG. 1.

In FIGS. 1 to 3 a servo valve 1 of the invention is shown. The servo valve 1 may be used to convert a small electrical input signal into a hydraulic output signal in an analog manner.

The embodiment shown relates to a two stage directional servo valve comprising in substance a first and a second stage. The first stage comprises an electrical control motor and a hydraulic amplifier 3. The second stage is not referred to in detail and is located in FIG. 1 below the hydraulic amplifier 3. The present invention relates in particular to the first stage and within said stage to the electric control motor 2. The control motor 2 is energized by means of permanent magnet means and is hermetically sealed relative to the hydraulic amplifier 3.

The control motor 2 is mounted on an assembly surface 4 of the hydraulic amplifier 3.

The control motor comprises a support plate 5 placed with its bottom surface on said assembly surface 4. Mounted on the upper surface of the support plate 5 is a support member 6 of the invention. The support plate 5 is of generally circular shape and is provided with a center shape 52, again of circular shape.

The support member 6, described more fully below, is generally U-shaped and is adapted to receive two pole screws 61, 62 which are located diametrically opposite to each other. The pole screws 61, 62 are screwed into appropriate threaded bores 65, 66 of the support member 6. The pole screws 61 and 62 support in turn the coils 63 and 64, respectively.

The U-shaped support member 6 is closed at its upper end by means of a substantially rectangular closing plate 7. A permanent magnet 71 is glued centrally to the bottom surface of the closing plate 7, and a flow conducting member 72 is glued to the bottom surface of the permanent magnet 71.

The control motor 2 is completed by an armature 8 which is located in the area of the pole screws 61 and 62. The armature 8 is supported at one end of a resilient tube 9. The other end of the resilient tube 9 is fixedly mounted at the support plate 5.

The U-shaped support member 6 is preferably made of soft iron showing little hysteresis and is mounted to the support plate of the control motor by means of screws 51 (see FIGS. 2 and 3).

The U-shaped support member 6 is of integral design and comprises two spaced apart side walls 60 and 80 which are connected with each other by means of a connecting member. Centrally, within the connecting member 70, a recess 67 is formed so as to provide for a fit with the central section 52 of the support plate 5.

The support member 6 may be manufactured for instance from a cylindrical metal member in such a manner that the recess between the two side walls 60 and 80 is milled away, so that the two support surfaces 53 and 54 (shown in FIGS. 2 and 3) for the screws 51 are formed.

Approximately at a level half the height of the side walls 60, 80 the threaded bores 65, 66 are provided diametrically opposite to each other. The pole screws 61, 62 can be threadably inserted into threaded bores 65, 66. The two pole screws 61, 62 are of identical design and comprise a threaded head having a larger diameter and a support portion having a smaller diameter. On the support portion, the appropriate coil 63 or 64 is located. The support member has a circular cross section and a diameter approximately of the same dimension as the height of the armature 8 described more fully below.

Each of said coils 63 and 64 is located on an insulating body 68 and 69, respectively. Each of said insulating bodies 68, 69 is located with its circular shaped inner bore on an appropriate support member of the pole screws 61 and 62, respectively. The outer circumference of the insulating bodies 68 and 69, is square shaped, so that the insulating bodies can not rotate on the support member 6. From above, the insulating bodies 68, 69 are maintained in position by means of the bottom surface of the closing plate 7. The closing plate 7 in turn is fixedly mounted by means of screws 73 to the side walls or legs 60 and 80.

Between the pole screws 61, 62 and the coils 63, 64 an armature space 82 (see FIG. 1) is defined. The armature 8 is centrally located in armature space 82 in the area of the ends of the pole screws 61 and 62 which face toward the armature space 82. The armature 8 is made of soft iron. The armature 8 forms together with the appropriate pole screws 61 and 62 air gaps 83 and 84, respectively.

The armature 8 has essentially the form of a parallelepiped. The larger rectangular surfaces of the armature face towards the inner surfaces of the pole screws 61 and 62. The longitudinal extension of said rectangles—see FIG. 2—is larger than the diameter of the support members of the pole screws 61 and 62. However, the overall design is generally symmetrical. The rectangular surface formed by the armature 8 and facing upwardly towards the closing plate 7 forms together with the bottom surface of the flow conducting member 72 an air gap 85. Preferably, the upper rectangular surface of the armature 8 is smaller than the rectangular surfaces forming air gaps 83 and 84.

The permanent magnet 71 preferably consists of a samarium cobalt material. The permanent magnet 71 and the flow conducting member 72 glued thereto have surfaces facing towards the air gap 85 with the same size as the oppositely located surface of the armature 8.

As was already mentioned the armature 8 is supported by a resilient tube 9. The tube 9 comprises an upper, wider tube section 91, and contiguous thereto a narrow tube section 92, and again contiguous thereto a lower, wider tube section 93. Tube 9 is mounted with its lower wider tube section 93 by means of an interference fit within a central bore in a central section 52 of the support plate 5 of the control motor 2. The central section 52 extends away from the support plate 5 and is located in a bore 41 of the hydraulic amplifier 3.

A tap bore extends centrally and upwardly within the armature 8. The armature 8 is mounted by means of an interference fit to the upper wider tube section 91. In a manner known per se the movements of the armature 8 are transferred to a flapper element 81 which extends downwardly and projects out of the resilient tube 9 into an area between the two nozzles 31. The operation of said nozzles 31 responsive to movement of the flapper element 81 is well known and also the effect created thereby with regard to the second stage of the servo valve 1.

The flapper element 81 extends within the tube 9 upwardly and is mounted by means of an interference fit to the tube 9 approximately in the area of the upper wider tube section 91.

A housing 10 is mounted by means of screws 11 to the assembly surface 10 and is adapted to provide protection for the components of the control motor 2. Between the housing 10 and the assembly surface 4 a seal 12 is provided, and between the center section 52 and the bore 41 in the member comprising the assembly surface 4 a seal 13 is provided.

A man skilled in the art will understand the operation of the control motor of the invention based on the above description. If it is assumed that the permanent magnet 71 has its north pole N for example at the upper end and its south pole S at the lower end, then the end of the armature adjacent to the south pole of magnet 71 will behave like a north pole. An energization of the coils 63 and 64 will lead to a movement of the flapper element 81, which is between the nozzles 31, 31. More particularly if coil 63 is energized such that as is shown a north pole faces towards the armature and oppositely thereto a south pole is created, while simultaneously the coil 64 is energized such that a south pole faces towards the armature and oppositely thereto a north pole is provided (as is also shown), then the movement of the armature 8 and the flapper element 81 mounted thereto occurs in the one direction (to the left in FIG. 1), while, for the polarities given in the drawing in parentheses the movement occurs in the other direction.

The control motor 2 of the invention is specifically useful for low power ratings. The design is extremely compact. The armature may have a small mass, which results in a higher frequency response.

In accordance with the invention the magnetic force acting on the armature 8 may be adjusted by rotating the pole screws 61 and 62. Because the coils 63 and 64 are directly located on the respective pole screws 61 and 62 only a small stray factor and small losses are to be expected. So far it was necessary that the coils had to accomodate the movement of the wings provided at the armature.

The control motor 2 of the invention is of stable design and requires fewer components than prior art control motors. For all practical purposes, the control motor of the invention is shrunk to a circular cylindrical shape.

It should be noted that the control motor of the invention uses in contrast to the prior art not a double polarized but a single polarized permanent magnet 71. This permanent magnet 71 is mounted on a flow conducting member preferably in the form of the closing plate 7. Preferably the permanent magnet 71 consists of cobalt samarium and has preferably the form of a parallel epiped. Preferably the permanent magnet 71 is mounted at the closing plate 7 by means of an adhesive.

It is also conceivable to mount the permanent magnet 71 at the upper end of the armature 8. This, however, would lead to a larger mass which needs to be accelerated.

It should be further noted that the flow conducting member 72 can be omitted and that the permanent magnet 71 directly faces the air gap 85.

I claim:

1. A control motor for a servo valve, comprising:

pole means comprising a U-shaped support member including two diametrically oppositely disposed side wall elements defining an armature space;

a closing plate mounted to and extending between first ends of said sidewall elements;

first and second control spool elements supported by said pole means and disposed between said sidewall elements;

a thin walled tube;

a soft metal armature member resiliently mounted to said tube and disposed between said spool elements within said armature space; and permanent magnet means including a permanent single polarized cobalt-samarium magnet mounted to said closing plate member for polarizing said armature member.

2. The control motor of claim 1, wherein said pole means comprise first and second pole screws defining therebetween said armature space; said armature member being substantially rectangular and having two long sides and two short sides; said long sides being disposed adjacent to said pole screws, respectively, an air gap being defined between each long side and said respective pole screw.

3. The control motor of claim 2, wherein said permanent magnet is disposed adjacent an upper surface of said armature member and is spaced therefrom so as to define an air gap therebetween.

4. The control motor of claim 2, wherein said pole screws are disposed within said U-shaped support member.

5. The control motor of claim 4, wherein said side wall elements include diametrically oppositely extending threaded bores into which said pole screws are threadedly received.

6. The control motor of claim 5, wherein in each said pole screw includes a threaded head portion at one end thereof and a support portion adjacent and extending inwardly relative to said head portion so as to form a support for an associated spool element.

7. The control motor of claim 1 wherein a flow conducting member is fixedly mounted on a surface of said permanent magnet facing said armature member.

* * * * *